United States Patent [19]

Chu

[11] 4,135,654

[45] Jan. 23, 1979

[54] RUCKSACK FRAME

[75] Inventor: Cheuk S. Chu, Kowloon, Hong Kong

[73] Assignee: Yip Hing Camping Goods Manufactury Limited, Hong Kong

[21] Appl. No.: 786,216

[22] Filed: Apr. 11, 9177

[30] Foreign Application Priority Data

Apr. 13, 1976 [GB] United Kingdom ..... 15080/76

[51] Int. Cl.[2] ..... A45F 3/08

[52] U.S. Cl. ..... 224/25 A; 224/8 R

[58] Field of Search ..... 224/8 R, 6, 25 R, 25 A; 9/6 P; 135/7.1 R; 46/16, 23, 27; 52/729, 728, 730; 211/191; 312/257 SK; 5/82; 182/46, 218, 219

[56] References Cited

U.S. PATENT DOCUMENTS

| | | | |
|---|---|---|---|
| D. 242,799 | 12/1976 | Schmidt | 52/729 X |
| 3,648,907 | 3/1972 | Romney | 224/25 A |
| 3,938,718 | 2/1976 | Madison | 224/25 A |

*Primary Examiner*—Trygve M. Blix
*Assistant Examiner*—Sherman D. Basinger
*Attorney, Agent, or Firm*—Toren, McGeady and Stanger

[57] ABSTRACT

The rucksack frame comprises longitudinal and transverse plastics members of generally C-shaped cross-section, open towards the rear of the frame. Each member has an integral rib, preferably of round cross-section, which extends along the interior of the member and strengthens it against bending or breaking.

5 Claims, 5 Drawing Figures

RUCKSACK FRAME

This invention relates to a rucksack frame.

The invention provides a rucksack frame comprising longitudinal and transverse plastics members which are substantially tubular but are open towards the rear of the frame so that they are of generally C-shaped cross-section, each said member having an integral rib extending along its interior.

The ribs strengthen the members against bending or breaking and are preferably of round cross-section. It is also preferable for each member to be strengthened by integral cross-pieces extending across its interior at spaced intervals. At least some of the said members may be locally filled in by integral blocks through which pass holes for attachment cords; such blocks also strengthen the members. Struts, preferably of I-section, may conveniently interconnect the said members.

The invention will be described further, by way of example only, with reference to the accompanying drawings, in which.

Figure 3:
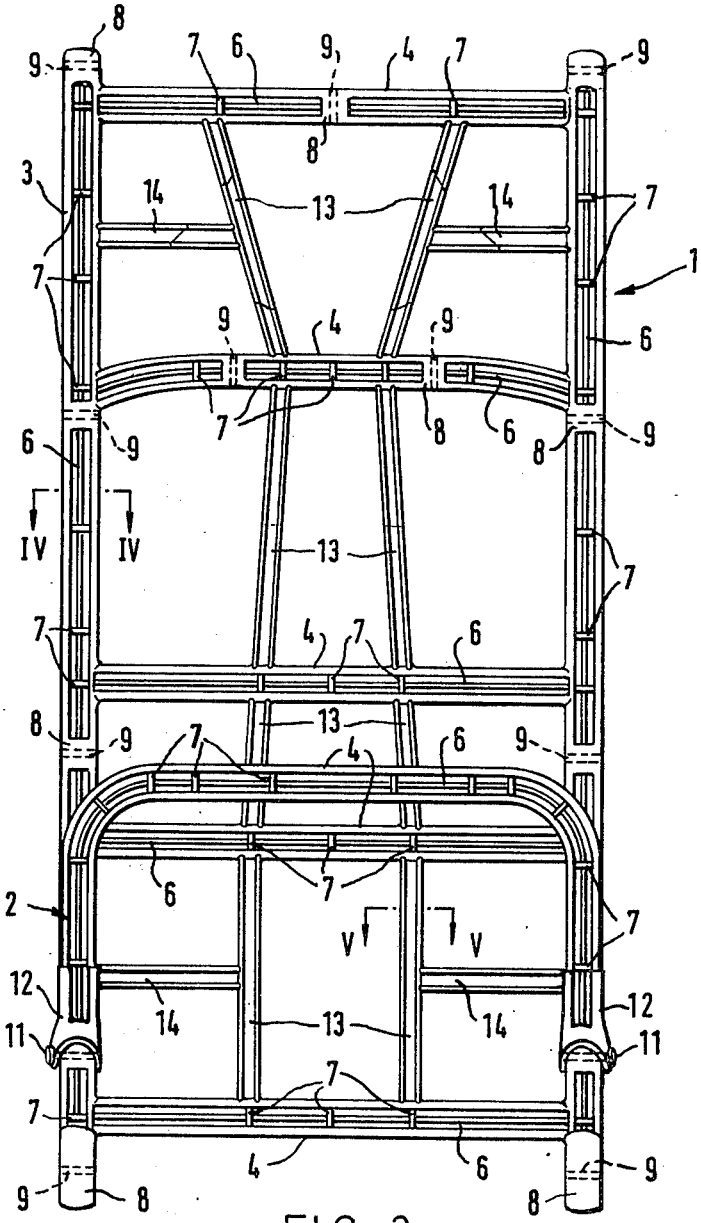
FIG. 3 is a rear view of the frame, with the support part raised.
Figure 4:
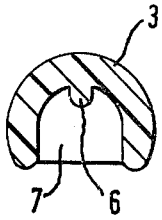
FIG. 4 is a section on line IV—IV in FIG. 3.

The rucksack frame illustrated comprises two parts which each consist of a plastics moulding, viz. a main part 1 which is specially shaped to fit the wearer's back and a support part 2 hinged to the main part. The frame has two longitudinal members or pillars 3 and a plurality of transverse members 4. The members 3,4 are substantially tubular but are open towards the rear of the frame (see FIG. 3) so that they are of generally C-shaped cross-section (see FIG. 4, for example). Each member 3 or 4 has an integral rib 6 of round cross-section extending along its interior diametrically opposite the opening in the member. The ribs 6 strengthen the hollow members 3,4 against bending or breaking.

Figure 1:
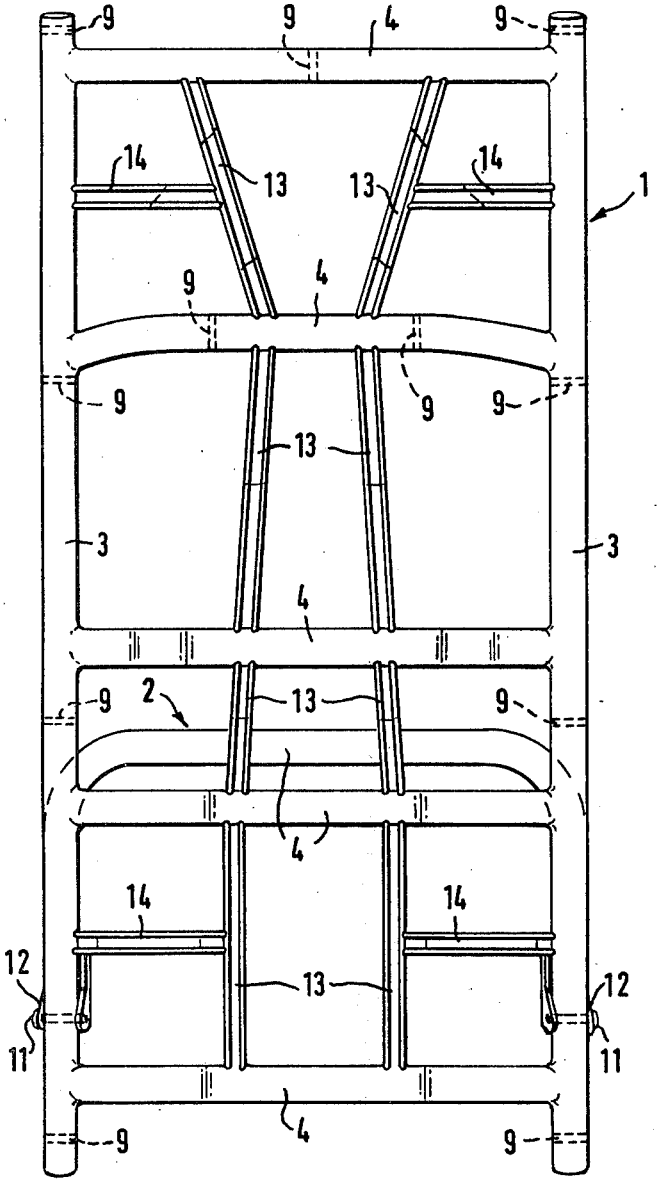
FIG. 1 is a front view of a rucksack frame, with the support part raised.
Figure 2:
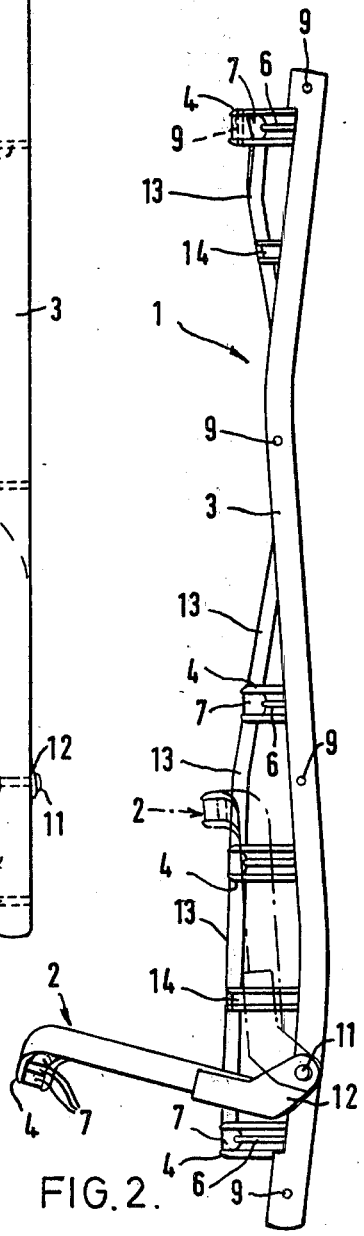
FIG. 2 is a side view of the frame, with the support part lowered (the raised position being indicated by chain-dotted line)

The members 3,4 are not entirely hollow along their length. Firstly they are additionally strengthened by integral plate-like cross-pieces 7 (see FIGS. 3 and 4). Secondly they are locally filled in by integral blocks 8 (FIG. 3); at these positions holes 9 (FIGS. 1 and 3) are formed for attachment cords. Thirdly, two hinge pins 11 pass through similar filled-in parts of the respective longitudinal members or pillars 3 and carry respective brackets 12 integrally formed on the support part 2.

Figure 5:
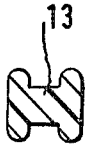
FIG. 5 is a section on line V—V in FIG. 3.

The transverse members 4 of the main part 1 are interconnected by longitudinal struts 13 of I-section (see FIG. 5), providing the frame with additional strength and rigidity. The uppermost and lowermost struts 13 are connected to the pillars 3 by similar transverse struts 14, also of I-section.

I claim:

1. A rucksack frame comprising longitudinal and transverse plastics members which are substantially tubular but are open towards the rear of the frame so that they are of generally C-shaped cross-section, each said member having an integral rib extending along its interior and with each member having integral cross-pieces extending across its interior at spaced intervals.

2. The rucksack frame of claim 1, in which the ribs are of round cross-section.

3. The rucksack frame of claim 1, further comprising plastics struts interconnecting the said members.

4. The rucksack frame of claim 3, in which the struts are of I-shaped cross-section.

5. A rucksack frame comprising longitudinal and transverse plastics members which are substantially tubular but are open towards the rear of the frame so that they are of generally C-shaped cross-section, each said member having an integral rib extending along its interior, with at least some of said members having the interior of said C-shaped configuration filled in over only a discreet portion of the length thereof with integral blocks, said blocks having holes formed therethrough.

* * * * *